US005207846A

United States Patent [19]

Kelly

[11] Patent Number: 5,207,846

[45] Date of Patent: May 4, 1993

[54] TANTALUM-CONTAINING SUPERALLOYS

[75] Inventor: Thomas J. Kelly, Cincinnati, Ohio

[73] Assignee: General Electric Company, Cincinnati, Ohio

[21] Appl. No.: 658,417

[22] Filed: Feb. 19, 1991

Related U.S. Application Data

[63] Continuation-in-part of Ser. No. 335,353, Apr. 10, 1989, abandoned.

[51] Int. Cl.[5] ..... C22C 30/00; C22F 1/10

[52] U.S. Cl. ..... 148/675; 148/410; 148/419

[58] Field of Search ..... 148/410, 419, 162, 428, 148/675

[56] References Cited

U.S. PATENT DOCUMENTS

| | | | |
|---|---|---|---|
| 3,668,023 | 6/1972 | Kotval | 148/162 |
| 4,981,644 | 1/1991 | Chang | 148/410 |

FOREIGN PATENT DOCUMENTS

| | | |
|---|---|---|
| 0208645 | 1/1987 | European Pat. Off. . |
| 225837 | 6/1987 | European Pat. Off. . |
| 0225837 | 6/1987 | European Pat. Off. . |
| 0246082 | 11/1987 | European Pat. Off. . |
| 2220589 | 4/1974 | France . |
| 2328544 | 5/1977 | France . |
| 1011785 | 12/1965 | United Kingdom . |
| 1052561 | 12/1966 | United Kingdom . |
| 1260982 | 1/1972 | United Kingdom . |
| 1381859 | 1/1975 | United Kingdom . |
| 1409628 | 10/1975 | United Kingdom . |
| 1471053 | 4/1977 | United Kingdom . |
| 2152075 | 7/1985 | United Kingdom . |
| 2191505 | 12/1987 | United Kingdom . |

*Primary Examiner*—R. Dean
*Assistant Examiner*—Margery S. Phipps
*Attorney, Agent, or Firm*—Jerome C. Squillaro; Carmen Santa Maria

[57] ABSTRACT

Nickel base superalloys which contain niobium (columbium) to promote gamma double prime strengthening are improved by replacing the niobium with tantalum on an atom-for-atom basis and then heat treating the new alloy at temperatures in excess of those conventionally used for superalloys which include niobium. The resultant tantalum-bearing alloys are found to exhibit increased strength and greater phase stability than corresponding niobium-bearing alloys.

5 Claims, 1 Drawing Sheet

TANTALUM-CONTAINING SUPERALLOYS

This application is a continuation-in-part of application Ser. No. 335,353, filed Apr. 10, 1989, now abandoned.

BACKGROUND OF THE INVENTION

1. Field of the Invention

The present invention relates to improved nickel base alloys which have a particularly high combination of strength properties and ductility over the temperature range extending from about room temperature to approximately 1500° F. The improvement is provided by incorporating a substantial amount of tantalum in the alloy, generally as an atom-for-atom replacement for niobium, and then heat treating the alloy at very high temperatures for extended periods.

2. Description of the Prior Art

Prior art nickel-base superalloys while steadily being improved, have disadvantages either from a standpoint of strength or ductility, particularly at elevated temperatures, i.e., above about 1200° F. These alloys are generally based upon nickel in combination with one or more of chromium, iron, and cobalt. In addition, they may contain a variety of elements in a large number of combinations to produce desired effects. Some of the elements which have been utilized in nickel-base superalloys to provide or improve one or more of the following properties are: strength (Mo, Ta, W, Re), oxidation resistance (Cr, Al), phase stability (Ni) or increased volume fractions of favorable secondary precipitates (Co). Other elements are added to form hardening precipitates such as gamma prime (Al, Ti) and gamma double prime (Cb). Minor elements (C, B) are added to form carbides and borides and others (Ce, Mg) are added for purposes of tramp element control. Some elements (B, Zr, Hf) also are added to promote favorable grain boundary effects. Many elements (e.g., Co, Mo, W, Cr), although added for their favorable alloying qualities, can participate, in some circumstances, in the formation of undesirable phases (e.g., sigma, mu, Laves).

Gamma double prime is generally considered to be a body centered tetragonal ordered $Ni_3Nb$ strengthening precipitate which is formed when niobium is present in nickel-base superalloys. A superalloy in which gamma double prime strengthening occurs is Inconel 718 which is within the scope of U.S. Pat. No. 3,046,108 (Eiselstein). Eiselstein teaches that the alloy must contain about 4 to about 8 weight percent columbium and that the columbium in the alloy may be replaced in part with tantalum in an amount of up to 4% of the alloy. In partially replacing the columbium content of the alloy with tantalum, Eiselstein teaches that double the weight of tantalum should be used to obtain the same effect on properties. He also teaches that only tantalum-free alloys and/or alloys wherein not more than 50% of the columbium is replaced by tantalum are notch-ductile at elevated temperatures. Eiselstein thus teaches that tantalum and niobium act the same in nickel-based alloys provided that only a limited amount of tantalum is present.

The gamma double prime phase is not normally a stable phase since it can convert to gamma prime or to delta on extended exposure to elevated temperatures. Alloys hardened with gamma double prime achieve high tensile strength and very good creep rupture properties at lower temperatures, but the conversion of gamma double prime to gamma prime or delta above about 1250° F. causes a sharp reduction of strength. (Donachie, M. J., "Relationship of Properties to Microstructure in Superalloys" in Superalloys Source; Book, American Society for Metals, 1984).

SUMMARY OF THE INVENTION

It has now been discovered that tantalum does not act the same as niobium in nickel base superalloys. Rather, tantalum has been found to produce an alloy which has greater phase stability and different phase relationships than the corresponding niobium containing alloy. This difference in phase stability makes the Ta containing alloys much stronger to much higher temperatures than Nb containing alloys. In addition, the gamma double prime in the alloys of the invention does not readily convert to delta phase as occurs in niobium-bearing counterpart alloys.

The present invention particularly contemplates a nickel base alloy which comprises at least about 30 weight percent nickel, about 8 to about 16 weight percent tantalum and which is substantially niobium-free. Additional elements contained in the alloy are Primarily selected from the group consisting of chromium, iron, cobalt, molybdenum, titanium, zirconium, tungsten, hafnium, aluminum, boron, and carbon and combinations thereof. In addition, other elements such as manganese, silicon, phosphorus, sulfur, lead, bismuth, tellurium, selenium, niobium and silver may also be present as incidental impurities.

The invention further extends broadly to the method for improving the high temperature strength properties of niobium-bearing nickel base superalloys by replacing substantially all of the niobium contained therein with tantalum on an atom-for-atom basis.

The invention also comprehends a method for improving the high temperature strength properties of the tantalum-bearing nickel base superalloys of the invention by heat treatments at higher temperatures and for longer duration than those used for their niobium-bearing counterparts.

DESCRIPTION OF THE PREFERRED EMBODIMENT

The alloys of the present invention contain at least about 30% nickel (all percents expressed herein and in the claims are by weight unless otherwise specified) and about 8 to about 16% tantalum. The balance of the alloy will consist of other elements which are conventionally alloyed with nickel to form superalloys such as elements selected from the group consisting of chromium, iron, cobalt, molybdenum, titanium, zirconium, tungsten, hafnium, aluminum, boron, carbon and combinations thereof. Further, other elements such as manganese, silicon, phosphorus, sulfur, lead, bismuth, tellurium, selenium, and silver may also be found in the alloy as incidental impurities. These alloys will be substantially niobium-free, i.e., they will contain less than about 1%, preferably less than 0.5%, and most preferably less than about 0.1% Nb.

Generally, the alloy will contain, in addition to nickel and tantalum, up to about 25% chromium, up to about 40% iron, up to about 25% cobalt, up to about 8% molybdenum, up to about 3% titanium, up to about 2% aluminum, up to about 7% tungsten about 30 to about 150 ppm boron, and up to about 0.1% carbon. Other elements, such as those other alloying elements specified above, may be present in amounts up to about 1% each with a total maximum of up to about 5%.

One preferred alloy consists essentially of about 8 to about 16% tantalum, about 17 to about 22% chromium, up to about 25% iron, up to about 16% cobalt, but not less than 12% total Fe plus Co, about 2 to about 6% molybdenum, about 1 to about 5% titanium, about 0.1 to about 5% aluminum, about 30 to about 150 ppm boron, about 0.01 to about 0.1% carbon, the balance nickel (including incidental impurities), wherein the total amount of iron plus cobalt is about 8 to about 25%.

A second preferred alloy consists essentially of about 8.5 to about 10% tantalum, about 18 to about 20% chromium, about 17 to about 19% iron, about 2.5 to about 4% molybdenum, about 0.75 to about 2.5% titanium, about 0.25 to about 0.75% aluminum, about 30 to about 60 ppm boron, if the alloy is to be cast, or about 80 to about 150 ppm boron if the alloy is to be wrought, about 0.03 to about 0.05% carbon, the balance nickel. A most preferred version of this alloy consists essentially of about 9% tantalum, about 19% chromium, about 18% iron, about 3% molybdenum, about 1% titanium, about 0.5% aluminum, about 30 to about 60 ppm boron, if the alloy is to be cast, or about 80 to about 100 ppm boron if the alloy is to be wrought, about 0.05% carbon, the balance nickel.

A third preferred alloy consists essentially of about 30 to about 40% nickel, about 30 to about 40% iron, about 15 to about 23% cobalt, about 8 to about 16% tantalum, and about 30 to about 150 ppm boron. A more preferred version of this alloy consists essentially of about 35 to about 38% nickel, about 35 to about 38% iron, about 17 to about 20% cobalt, about 8 to about 10% tantalum, and about 30 to about 60 ppm boron, if the alloy is to be cast, or about 80 to about 100ppm boron if the alloy is to be wrought. A most preferred version of this alloy consists essentially of about 36 to about 37% nickel, about 36 to about 37% iron, about 17 to about 19% cobalt, about 8.5 to about 9.5% tantalum, and about 30 to about 60 ppm boron, if the alloy is to be cast, or about 80 to about 100 ppm boron if the alloy is to be wrought.

The alloys of this invention may be cast or wrought and may be produced by conventional methods.

For the alloys of the invention to develop their improved high temperature properties, they need to be heat treated. The heat treatment is conducted at a higher temperature for a substantially longer period than is conventionally used for similar niobium containing alloys.

The presently preferred heat treatment cycle for the second preferred alloy entails heating at about 2000° F. for about 1 hour, followed by hot isostatic pressing at about 2050° F, at a pressure of about 12 to about 15 ksi, for about 3 to about 5 hours, followed by heating at about 1925° F. for about 4 hours, and followed by heating at about 1600° F. for about 2 hours. An additional heating (aging) at about 1350° F for about 8 hours may be helpful to produce optimal properties with some alloys. The conventional heat treatment for this alloy in its niobium containing version would not include the 1600° F. step and would include a lower temperature aging step at about 1150° F for about 4 to 8 hours.

By the use of tantalum in the substantial absence of niobium in combination with the higher heat treatment conditions, alloys are produced which make greater use of gamma double prime strengthening than in conventional niobium-containing alloys. The alloys of the invention are age-hardenable, malleable, and are characterized by a high combination of strength and ductility, particularly at elevated temperatures. In addition, it is believed that the amount of aluminum plus titanium, if included in the alloy, can be increased above that conventionally found in niobium containing alloys without inducing strain age cracking of weldments. Another benefit of using tantalum instead of niobium in the alloys is improved weldability. This is due to an increased resistance to heat affected zone microcracking due to the higher Ta-Ni eutectic temperature compared to that of the Nb-Ni eutectic.

The following non-limiting examples are provided to demonstrate the preparation of alloys of the present invention and their improved properties, especially at high temperatures.

EXAMPLE I

A tantalum-containing alloy like 718 was produced by melting a composition of 48.6% nickel, 19.2% chromium, 18.0% iron, 0.02% niobium, 9.1% tantalum, 3.0% molybdenum, 1.04% titanium, 0.47% aluminum, 0.0043% boron, 0.044% carbon, and 0.02% silicon, in a vacuum induction furnace. The melted alloy was cast into ceramic molds to form 2"×4"×¼" slabs. Specimens from the slabs were subjected to heat treatment as follows: 2000° F. for 1 hour, 2050° F. hot isostatic pressing at 14.7 KSI for 3 hours, 1925° F. for 4 hours, 1600° F. for 2 hours, and then 1350° F. for 8 hours.

A conventional 718 alloy of the same composition containing essentially no tantalum, but about 4.6% niobium, was produced in the same manner as above and heat treated to conventional 718 practice (as noted in footnote 1 to Table I below).

The microstructure of the tantalum-bearing alloy is found to have equal or less stable Laves phase on solidification as the conventional 718 alloy. In addition, the tantalum-bearing alloy does not produce the delta phase after exposure in the 1600° F. to 1800° F. range; a heat treatment which is used to determine element segregation in 718 alloys (delta dump). The microstructure of the tantalum-bearing alloy has an excellent distribution of gamma prime and gamma double prime of a size which produces a reasonable strengthening effect. The gamma prime and gamma double prime precipitate in the tantalum-bearing alloy is much more uniformly distributed throughout the dendrite cores and interstices than in conventional cast 718.

Specimens of the two alloys were evaluated to determine their mechanical properties at both room temperature (RT) and at elevated temperature. The results are:

TABLE I

| | Cast Ta 718[1,3] | | | Cast Nb 718[1] | | Cast Ta 718[2,4] | | |
|---|---|---|---|---|---|---|---|---|
| | RT | 1200 | 1300 | RT | 1200 | RT | 1200 | 1400 |
| UTS | 155.3 | 130 | 122 | 151 | 117 | 178.2 | 147.7 | 133.3 |
| 0.2% | 118.1 | 114 | 106.5 | 133 | 104 | 142.5 | 117.8 | 112.6 |
| % El | 19 | 11.5 | 9 | 15 | 11 | 12 | 11 | 6 |
| % RA | 29.1 | 22.5 | 21.5 | 29 | 29 | 18 | 8 | 6 |

[1]2000° F./1 hr; 2050 hip/14.7 ksi/3 hr; 1925/1 hr; 1350/8 hr; 1150/8 hr.
[2]2000° F./1 hr; 2050 hip/14.7 ksi/3 hr; 1925/1 hr; 1600/2 hr; 1350/8 hr.
[3]average of 2 specimens
[4]one specimen As may be noted from Table I, the tantalum-bearing 718 type superalloy showed improved elevated temperature strength properties over its niobium-bearing counterpart and these properties were even further improved by the use of the preferred heat treatment.

EXAMPLE II

The procedure of Example I was repeated with an alloy whose composition was 36.6% nickel, 36.6% iron, 17.7% cobalt, 9.1% tantalum, and 45 ppm boron. The corresponding conventional alloy in which the tantalum is replaced with niobium on an atom for atom basis, i.e. the niobium content is 4.5%, was also prepared for comparison purposes. The alloys are evaluated for mechanical properties as in Example I. The results are:

TABLE II

| | Cast Ta Alloy | | Cast Nb Alloy | |
|---|---|---|---|---|
| | R.T. | 1200° F. | R.T. | 1200° F. |
| Ultimate tensile strength (KSI) | 182.5 | 141.8 | 135 | 108 |
| 0.2% Yield strength (KSI) | 159.4 | 128.6 | 120 | 89 |
| % Elongation | 4.5 | 3.0 | 4.0 | 7.0 |
| % Reduction in area | 6.5 | 6.5 | 7.0 | 13.0 |

As is evident, the tantalum-bearing alloy of the present invention exhibits substantially increased ultimate tensile and yield strengths, reduced reduction in area, and similar elongation as compared to the same alloy containing niobium.

Evaluations of the various alloys again demonstrate the superiority of the tantalum-bearing alloy of this invention as compared to the comparable niobium-bearing alloy.

EXAMPLE III

Although the conventional 718 alloy of Example I is highly resistant to strain-age cracking during weld stress relief, the alloy can be susceptible to both liquation cracking in the weld heat-affected-zone (HAZ) and, under conditions of high restraint, solidification cracking in the weld fusion zone. To evaluate the effect of the tantalum for niobium substitution of the present invention, the alloy formation steps of Example I are repeated to produce cast-to-size weldability test specimens 5 mm in thickness. Prior to weldability testing all specimens were heat treated in vacuum at 2000° F. for one hour and cooled to 1200° F. in twenty minutes. Spot Varestraint and Mini Varestraint weldability tests were utilized to evaluate HAZ liquidation and fusion zone solidification cracking susceptibilities. In the Spot Varestraint test, strain is applied to a gas-tungsten-arc spot weld immediately after extinguishing the arc, thereby restricting cracking to the weld HAZ. During Mini Varestraint testing, straining occurs during the generation of a continuous gas tungsten-arc weld, with cracks forming primarily in the previously solidified fusion zone. Total crack length is utilized as the quantitative measure of cracking susceptibility.

As shown in Table III, the tantalum-bearing alloy exhibits the lowest susceptibility to weld HAZ cracking over the entire range of strain levels tested, i.e. 0.25 to 3% augmented strain, by the Spot Varestraint test.

TABLE III

| | Cast Alloy 718 | | | Cast Ta 718 | | |
|---|---|---|---|---|---|---|
| Strain | Cracks | TCL | MCL | Cracks | TCL | MCL |
| 0.29% | 24 | .422 | .032 | 12 | .214 | .025 |
| 0.29% | 26 | .493 | .033 | 12 | .240 | .028 |
| 1.16% | 33 | .671 | .040 | 19 | .391 | .034 |
| 1.16% | 35 | .775 | .040 | 20 | .462 | .034 |
| 2.9% | 42 | 1.008 | .055 | 30 | .664 | .039 |

TABLE III-continued

| | Cast Alloy 718 | | | Cast Ta 718 | | |
|---|---|---|---|---|---|---|
| Strain | Cracks | TCL | MCL | Cracks | TCL | MCL |
| 2.9% | 48 | 1.108 | .053 | 30 | .669 | .045 |

Cracks: number of cracks per weld
TCL: Total Crack Length
MCL: Maximum Crack Length

EXAMPLE IV

Figure 1:
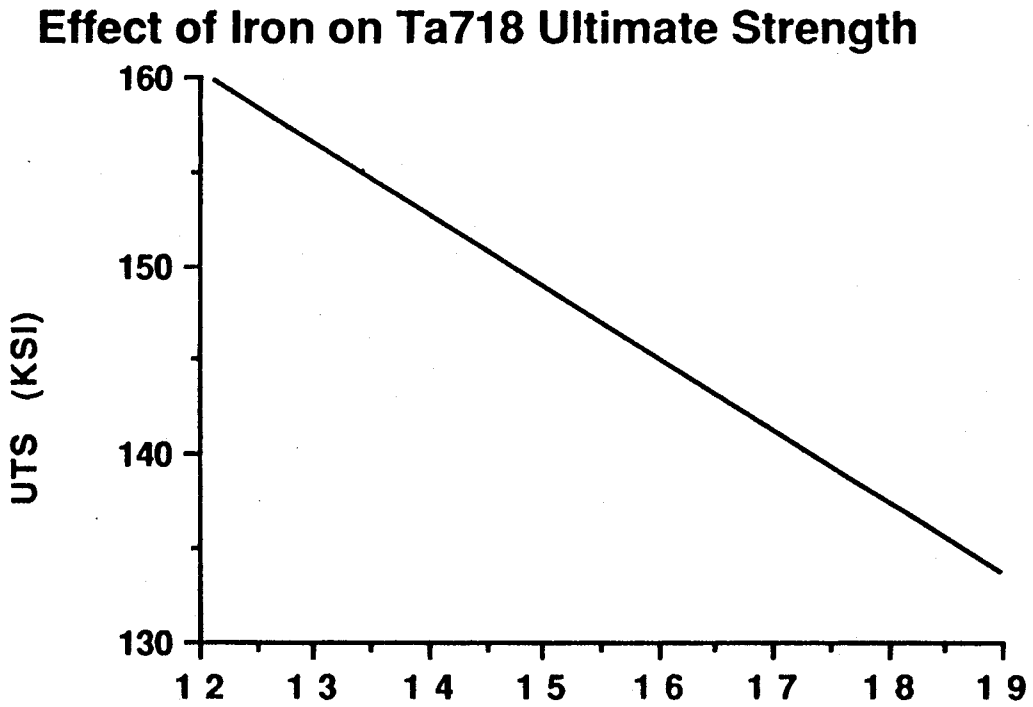
FIG. 1 is a graph representing a plot of the ultimate tensile strength vs. iron content of the alloys of the present invention.

Cast tantalum-containing nickel base superalloys having the chemical compositions listed in Table IV in accordance with the methods of Example 1.

TABLE IV

| Alloy | Fe | Al | Ti | Ta | Cr | Mo | B | C |
|---|---|---|---|---|---|---|---|---|
| HTD-1 | 12.98 | 0.49 | 1.55 | 8.97 | 19.08 | 2.98 | 0.0034 | 0.0234 |
| HTD-2 | 18.39 | 0.99 | 2.02 | 9.01 | 18.20 | 3.00 | 0.004 | 0.019 |
| HTD-3 | 13.34 | 0.99 | 1.03 | 9.05 | 18.15 | 3.09 | 0.0035 | 0.02 |
| HTD-4 | 18.02 | 1.01 | 1.53 | 9.11 | 18.07 | 2.98 | 0.0039 | 0.02 |
| HTD-5 | 18.29 | 0.50 | 2.04 | 9.02 | 18.29 | 2.99 | 0.0040 | 0.02 |
| HTD-6 | 13.36 | 0.50 | 1.03 | 9.02 | 18.12 | 3.06 | 0.0035 | 0.02 |
| HTD-7 | 20.44 | 0.54 | 0.91 | 8.96 | 18.90 | 3.28 | 0.004 | 0.06 |

*For HTD

The room temperature mechanical properties of each of the alloys is provided in Table V.

TABLE V

| Alloy | UTS (KSI) | RA (%) | TCL** |
|---|---|---|---|
| HTD-1 | 157.9 | 8.2 | 0.432 |
| HTD-2 | 131.6 | 4.4 | 0.496 |
| HTD-3 | 150.3 | 7.9 | 0.336 |
| HTD-4 | 132.3 | 7.2 | 0.872 |
| HTD-5 | 142.3 | 7.2 | 0.872 |
| HTD-6 | 154.7 | 8.0 | 0.448 |
| HTD-7 | ** | ** | ** |

*total crack length measured (inches)
**not available

The graph of the iron content is shown in FIG. 1. The data indicate that the iron content is influential in ductility and strength. Additionally the iron content affects weldability, as indicated by total crack length. From the data, the best combination of properties is obtainable with an iron content of about 11% to about 15%.

The preferred cast nickel-base tantalum containing alloy prepared in accordance with the methods of Example I has an alloy composition, within melt tolerances, consisting essentially of about 11.34–15.34% iron, about 16.15–20.15% chromium, about 2.79–3.39% molybdenum, about 8.81–9.31% tantalum, about 0.73–1.33% titanium, about 0.69–1.29% aluminum, about 0.003–0.007% boron, about 0.05–0.15% carbon and the balance essentially nickel. The nominal composition of this alloy consists essentially of about 13.34% iron, about 18.15% chromium, about 3.09% molybdenum, about 9.11% tantalum, about 1.03% titanium, about 1.0% aluminum, about 0.0035% boron, about 0.1% carbon and the balance essentially nickel.

The elevated temperature tests of the alloy of this nominal chemistry are provided in Table VI.

TABLE VI

| Temp. °F. | UTS (KSI) | YS (KSI) | RA (%) | % Elong. |
|---|---|---|---|---|
| 1200 | 135.8 | 121.2 | 15.7 | 4.8 |
| 1400 | 128.9 | 116.1 | 3.5 | 3.0 |
| 1600 | 82.4 | 82.4 | 11.8 | 1.6 |

In addition to these tests, notch-rupture/stress rupture tests at 65 ksi and creep tests at 25 ksi were run at 1400° F. for 100 hours and 1000 hrs respectively. The alloy of the preferred composition showed no susceptibility to stress-rupture failure at the stress levels and temperatures of test. The alloy also showed no susceptibility to creep failure at the stress levels and temperatures of test as indicated by zero strain measurement.

The unexpectedly superior combination of properties of the alloys of the preferred embodiment make it particularly suitable for applications in which these properties are required, even after a weld repair.

The alloys of the preferred composition are characterized by a microstructure having a uniform gamma prime and gamma double prime distribution of a size which produces a reasonable strengthening effect. The gamma prime and gamma double prime are much more uniformly distributed throughout the dendrite core and interstices than in conventional cast 718 alloys.

Although the present invention has been described in connection with specific examples and embodiments, it will be understood by those skilled in the arts involved that the present invention is capable of modification without departing from its spirit and scope as represented by the appended claims.

What is claimed is:

1. A superalloy which consists essentially of about 30 to about 40% nickel, about 30 to about 40% iron, about 15 to about 23% cobalt, about 8 to about 16% tantalum, and about 30 to about 150 ppm boron, the superalloy being characterized by a microstructure having a uniform distribution of gamma prime and gamma double prime precipitated, the gamma prime and gamma double prime having been formed within a gamma matrix by first heating the cast alloy to a temperature of about 2000° F. for about one hour, heating the alloy at a temperature of about 2050° F. for about 3 to about 5 hours, cooling the alloy to a temperature of about 1925°° F. and holding at 1925° F. for about 4 hours, cooling to a first aging temperature of about 1600° F. and aging for about 2 hours and optionally cooling to a second aging temperature of about 1350° F. and aging for about 8 hours.

2. The superalloy of claim 1 wherein the superalloy consists of in weight percent, about 35 to about 38% nickel, about 35 to about 38% iron, about 17 to about 20% cobalt, about 8 to about 10% tantalum, and about 30 to about 60 ppm boron if the superalloy is to be cast or about 80 to about 100 ppm boron if the superalloy is to be wrought.

3. The superalloy of claim 2 wherein the superalloy consists essentially of in weight percent, about 36 to about 3% nickel, about 36 to about 73% iron, about 17 to about 19% cobalt, about 8.5 to about 9.5% tantalum, and about 30 to about 60 ppm boron if the superalloy is to be cast or about 80 to about 100 ppm boron if the superalloy is to be wrought.

4. A method of improving the high temperature strength properties of a substantially niobium-free nickel-base superalloy consisting essentially of about 8.5 to about 10% tantalum, about 18 to about 20% chromium, about 17 to about 19% iron, about 2.5 to about 4% molybdenum, about 0.75 to about 2.5% titanium, about 0.25 to about 0.75% aluminum, about 30 to about 60 ppm boron if the alloy is to be cast or about 80 to about 100 ppm boron if the alloy is to be wrought, about 0.03 to about 0.05% carbon, the balance essentially nickel, comprising the steps of:

(a) heat treating at about 2000° F. for about 1 hour, (b) hot isostatic pressing at about 2050° F. at a pressure of about 12 to about 15 ksi for about 3 to about 5 hours, (c) heating to about 1925° F. and holding for about 4 hours, and (d) heating to about 1600° F. and holding for about 2 hours.

5. The method of claim 4 wherein the alloy is further aged at about 1350° F. for about 8 hours following the step of heating to 1600° F.

* * * * *